US005853128A

United States Patent [19]

Bowen et al.

[11] Patent Number: 5,853,128

[45] Date of Patent: Dec. 29, 1998

[54] SOLID/GAS CARBON DIOXIDE SPRAY CLEANING SYSTEM

[76] Inventors: Howard S. Bowen, 1475 Sterling Ave., Carpinteria, Calif. 93013; Richard M. Lee, 817—4th St. #304, Santa Monica, Calif. 90403; John H. Bowen, 9844 Darin Dr., Sandy, Utah 84070

[21] Appl. No.: 812,531

[22] Filed: Mar. 8, 1997

[51] Int. Cl.[6] ..... A62C 11/00

[52] U.S. Cl. ..... 239/329; 239/590; 134/7; 451/39

[58] Field of Search ..... 239/146, 373, 239/525, 532, 569, 575, 329, 590; 134/7; 451/39, 53, 102

[56] References Cited

U.S. PATENT DOCUMENTS

| | | | |
|---|---|---|---|
| 4,806,171 | 2/1989 | Whitlock et al. | 134/7 |
| 5,018,667 | 5/1991 | Lloyd | 134/7 X |
| 5,052,624 | 10/1991 | Boers et al. | 239/532 X |
| 5,222,332 | 6/1993 | Mains, Jr. | 451/39 |
| 5,294,261 | 3/1994 | McDermott et al. | 134/7 |
| 5,390,450 | 2/1995 | Goenka | 451/53 X |

*Primary Examiner*—Andres Kashnikow
*Assistant Examiner*—Steven J. Ganey
*Attorney, Agent, or Firm*—L. E. Carnahan

[57] ABSTRACT

Method and apparatus for controlling the exit velocity of solid/gas carbon dioxide spray cleaning systems. By increasing the pressure of liquid carbon dioxide in the supply line, typically in the range of 800–875 psi, to greater than 875 psi, preferably 2,000–5,000 psi and above, the velocity of the spray stream exiting the nozzle is increased enabling removal of contamination (oils, fingerprints, particles, graffiti, etc.) not removable with a spray stream using conventional carbon dioxide pressures. The apparatus includes the incorporation of a high-pressure pump in the liquid carbon dioxide supply line in combination with a nozzle having a first or inlet orifice smaller in diameter than the supply line and a second or exit orifice larger in diameter than the inlet orifice.

21 Claims, 4 Drawing Sheets

SOLID/GAS CARBON DIOXIDE SPRAY CLEANING SYSTEM

BACKGROUND

Field of Invention

The present invention relates to spray cleaning, particularly to solid/gas spray cleaning for removal of microscopic contamination, and more particularly to a solid/gas carbon dioxide spray cleaning method and apparatus, using single or multiple spray nozzles, which produce increased spray stream velocity and utilizes supply line pressures (1,000–10,000 psi), significantly greater than the typical supply line pressures (800–875 psi).

In recent years a great deal of attention has been directed to improving techniques for cleaning surfaces, particularly for the removal of film-like contamination such as finger prints, etc., or removing microscopic particles resulting from manufacturing residues, such as cutting or lubricating oils, mold release materials, salts, etc. Removal of film-like contamination or manufacturing residues has been typically carried out by various solvent processes, using fluid baths, sprays, vapor cleaners, etc.

In certain applications, the need for improved levels of cleanliness (ultra cleaning) has become more stringent, such as needed in the electronics industry involving removal of sub-micron particles, etc. As known, the smaller the particle to be removed, the greater the difficulty to remove it. The relative force of adhesion of particles rises exponentially as the particle size decreases. Thus, the prior utilized solvent processes were ineffective. As the force necessary to break the combined adhesion and binding charges of a particle rises, the amount of force required to remove the particle increases.

In efforts to remove microscopic (micron or submicron) particles, for example, investigators turned to the kinetic energy of droplet sprays or finely divided solids to remove the particles by means of momentum transfers. Such droplets typically comprised water or carbon dioxide sprays under high pressure driving gases to accelerate the droplets. These prior cleaning approaches are similar to the well known sand blasting techniques and, for many, application could not be used due to potential damage to the surfaces to be cleaned and thus could not be used for cleaning delicate surfaces.

Cleaning delicate surfaces with a strong spray stream consisting of sub-micron sized solid carbon dioxide particles propelled by gaseous carbon dioxide was first proposed by S. A. Hoenig (see "The application of dry ice to the removal of particulates from optical apparatus, spacecraft, semiconductor wafers and equipment used in contaminant free manufacturing processes", September 1985). The theory describing solid/gas carbon dioxide spray causes it to fall under the category of surface preparation and cleaning techniques in the form of a spray stream. The energy available in any spray stream can best be described by the sum of the kinetic energy of each solid component in the stream as defined in the following equation:

$$KE=\Sigma[\tfrac{1}{2}\times(M\times V^2)]$$

where: KE=kinetic energy available in the stream; M=mass per unit solid in the stream; and V=velocity of the solid in the stream.

For gaseous sprays (e.g. compressed dry air) the kinetic energy available is limited by the mass of the gas molecules, thus the energy of a gaseous spray stream can only be increased by increasing the velocity of the gas molecules. Typically gaseous spray streams do not have enough energy to remove contaminants from a surface that are strongly adhered, such as fingerprints. They are best suited for blowing off loose dirt particles and dust. Increasing the spray stream's energy one or two orders of magnitude by increasing the line pressure still does not add enough energy to enable a purely gaseous spray stream to remove stubborn contaminants.

The advantage solid/gas carbon dioxide spray has over gaseous sprays is that the mass term of the equation is increased significantly with the introduction of the solid carbon dioxide particles which in turn increases the kinetic energy available in the stream. The solid/gas carbon dioxide spray stream, with a nozzle exit velocity much lower than a gaseous spray stream, will remove contaminants the gaseous spray stream will not. In fact, the solid/gas carbon dioxide spray stream will remove contaminants that the gaseous spray stream is unable to remove at any nozzle exit velocity.

On the opposite end of the spectrum, the kinetic energy available in a spray stream containing a medium such as grains of sand or glass beads is proportional to the product of the medium's mass and velocity. Because the mass is usually very large, the velocity term can be small, and the coarse medium spray stream will still be able to remove strongly adhered contaminants such as paint and rust. The solid/gas carbon dioxide spray stream is different from the coarse medium spray stream in that the solid carbon dioxide particles are smaller than and not as heavy as the sand or glass beads. In order for the solid/gas carbon dioxide spray stream to contain the same amount of energy as the coarse medium spray stream, the velocity of the carbon dioxide solids must be greater.

The advantages of solid gas carbon dioxide spray over sand blasting or glass bead peening is that the solid carbon dioxide particles are extremely fragile. When they reach the surface, and particle velocity goes to zero, they give up their kinetic energy by knocking loose the contaminant, or through sublimation to become carbon dioxide gas. The amount of energy transferred into the surface from the impact is much less than the molecular forces holding the atoms together at the surface, such that no rearrangement of the atoms at the surface occurs. Thus, no signature (e.g. abrasion, scratching, denting, etc.) is left behind when the cleaning process is complete. Also, no residue is left behind after the solid carbon dioxide sublimes to become carbon dioxide gas other than the contaminant removed from the surface.

Following the initial efforts by S. A. Hoenig, referenced above, various efforts were directed to developing methods and apparatus capable of creating a spray stream of a mixture of frozen particles and a delivery gas, as well as the spray stream of solid/gas carbon dioxide. Most were merely capable of producing carbon dioxide solids in a carbon dioxide gaseous spray with no particular effort having been made to optimize the cleaning capability of the system. Only a slight improvement in cleaning over purely gaseous sprays was achieved by the earliest systems. Also, the carbon dioxide available at the time was not very pure or, if it was, it was very expensive. The impure carbon dioxide could not get pristine surfaces clean without leaving behind an undesirable residue, and the pure but expensive carbon dioxide was cost prohibitive.

In the late 1980's researchers at Hughes Aircraft Company began working to investigate and develop new cleaning techniques for optical surfaces. These researchers knew from prior experience that critical optical surfaces, such as vapor deposited gold coatings and pristine polished silicon, will adversely change when any physical contact occurs. The researchers at Hughes were able to improve upon the solid/gas carbon dioxide spray cleaning technology by designing equipment that was much better than the early designs; however, the Hughes Aircraft equipment was extremely expensive.

In the late 1980's and early 1990's other companies, encouraged after seeing the results achieved by Hughes and a few other entities, began developing and marketing solid/gas carbon dioxide spray cleaning equipment. These prior efforts are exemplified by U.S. Pat. Nos. 4,806,171 issued Feb. 21, 1989 to W. H. Whitlock et al, assigned to the BOC Group, Inc; No. 4,962,891, issued Oct. 16, 1990 to L. M. Layden, assigned to the BOC Group, Inc.; No. 5,125,979, issued Jun. 30, 1992 to E. A. Swain et al, assigned to Xerox Corporation; No. 5,315,793 issued May 31, 1994 to R. V. Peterson et al, assigned to Hughes Aircraft Company; No. 5,354,384, issued Oct. 11, 1994 to J. D. Sneed et al, assigned to Hughes Aircraft Company; No. 5,364,474, issued Nov. 15, 1994 to J. F. Williford, Jr.; No. 5,390,450, issued Feb. 21, 1995 to L. N. Goenka, assigned to Ford Motor Company; No. 5,409,418, issued Apr. 25, 1995 to K. Krone-Schmidt et al, assigned to Hughes Aircraft Company; and No. 5,558,110 issued Sep. 24, 1998 to J. F. Williford, Jr.

There exist several physical parameters and conditions that define the limits within which solid/gas spray cleaning operates: a) nozzle type, b) temperature drop of the surface caused by the solids incident upon it, c) consumption rate through the orifice vs. supply to the orifice, d) pressure inside the cylinder, and e) velocity of the solids in the spray stream. These five conditions are described hereinafter:

a) Nozzle Types:

Two distinct nozzling techniques are used to create the solid/gas spray mixture, namely gaseous and liquid conversion. Nozzles can be designed to present a point spray or linear spray stream.

The gaseous conversion technique draws the gaseous carbon dioxide from the top of the cylinder and passes it through a nozzle that has two separate chambers before the solid/gas spray mixture exits the nozzle. In the first chamber the gas expands rapidly to form small solid carbon dioxide particles. In the second chamber the small solids join to form slightly larger solids which then exit the nozzle.

The liquid conversion technique draws the liquid carbon dioxide from the bottom of the cylinder through a siphon tube and presents it at an orifice in a nozzle. Most of the liquid expands rapidly as it passes through the orifice forming carbon dioxide gas which serves as the propellant. As the liquid droplets give up their heat, the liquid on the outside of the droplets expands to become carbon dioxide gas, the temperature of the central core drops to approximately −110° F. and the droplets freeze to form the solids in the spray stream. The process, commonly referred to as adiabatic expansion, causes solids to form when a liquid under pressure is allowed to expand rapidly. The pressure of the liquid must be sufficient to cause the rapid expansion , or the solids will not form, and only liquid or gas will exit the nozzle.

b) Cooling the Surface:

When the solid carbon dioxide particles, at a temperature of −110° F., impact the surface and break apart, they extract heat from the surface. In materials with a low thermal mass, the temperature can drop as much as 60° F. per second. If and when the surface is cooled below the dewpoint temperature, water vapor will collect on the surface and form ice, trapping the contaminants which prohibit cleaning.

The gaseous conversion technique converts only about 5 percent of the liquid into solid carbon dioxide particles, thus the concentration of solids in the spray stream is low. On the other hand, gaseous conversion technique does offer an advantage in that the lack of solids in the spray stream will not cool the surface being cleaned as much as the liquid conversion method.

The liquid conversion technique converts approximately 40 percent of the liquid carbon dioxide into solids. The increase in solids offers the advantage of having more kinetic energy available in the spray stream, but the higher concentration of solids cools the surface being cleaned much quicker than the gaseous conversion technique. Therefore, the gaseous conversion method is able to clean some contaminants more effectively than the liquid conversion technique because it does not cool the surface as much while it cleans. On the other hand, the liquid conversion technique will remove contaminants the gaseous conversion technique will not because its spray stream has more kinetic energy.

c) The Rate of Liquid Consumption Through the Orifice:

As the liquid present at the entrance to the orifice is consumed, it must be replenished by the supply line. If the supply line is unable to provide sufficient liquid at a rate equal to or greater than the rate at which it is being consumed, the exit stream will hesitate from the point when the liquid behind the orifice is completely exhausted until it is refilled. This phenomenon is referred to as sputtering.

When the liquid is almost exhausted, and not yet re-supplied, larger solid particles of carbon dioxide will form that are too heavy to be pushed out of the nozzle. If they remain in the nozzle, the liquid behind the orifice is replenished and the pressure builds up to the point sufficient to propel the larger solids. When they do leave the nozzle, the larger solids can be large enough that the mass term in the above equation will cause the kinetic energy available in the stream to exceed the damage threshold energy of some delicate surfaces. When the large solids strike the surface, they can adversely change the surface. This phenomenon is referred to as spitting.

The rate at which the liquid behind the orifice is replaced depends upon four parameters of the nozzle design. The first parameter is the diameter of the orifice, the second is the diameter of the supply line, the third is the size of the reservoir behind the orifice, and the fourth is the pressure inside the supply line and reservoir. By adjusting each of the three parameters, the problems of spitting and sputtering can be avoided.

A physical limitation of the current state of the art technology is that the supply line diameter must always be greater than the orifice diameter or the end of the supply line will act as the orifice. In fact, if a constriction occurs in a supply line, somewhere between the main source of carbon dioxide and the nozzle, solids could be generated at the point of constriction which may be a great distance from the nozzle exit rather than at the nozzle orifice.

d) The Pressure Inside the Cylinder:

Carbon dioxide is typically produced and sold as a liquid in containers ranging in size from a few ounces to thousands of gallons. Carbon dioxide gas can be drawn from the top of the cylinder, and liquid carbon dioxide can be drawn from the bottom by inverting the cylinder or installing a siphon tube that reaches the bottom. At room temperature, approximately 70° F.,the pressure inside a cylinder containing liquid carbon dioxide is approximately 850 psi. When the temperature of the liquid inside the cylinder drops, there is a corresponding drop in pressure. When the temperature of the liquid falls, and the pressure drops below that at which adiabatic expansion occurs, the liquid will vaporize and exit the nozzle as carbon dioxide gas.

When the temperature rises above 87.8° F., and the pressure is increased above 1071 psi (the critical point), the carbon dioxide inside the volume of the cylinder converts to its supercritical phase which will not support a liquid and gas phase simultaneously. Instead, a plasma of carbon dioxide is created which occupies the entire space of the cylinder or chamber. State of the art solid/gas carbon dioxide spray cleaning systems will not operate if the supply line is at supercritical conditions.

The Velocity of the Solids in the Stream

The desire of carbon dioxide spray cleaning equipment manufacturers has been to increase the velocity of the solids exiting the nozzle while minimizing the concentration of solids in the spray stream. The reasons discussed previously are that by increasing the velocity of the solids the kinetic energy available in the spray stream will increase and, by minimizing the concentration of solids, it will minimize the cooling that takes place at the surface being cleaned.

The difficulty has been that the only way to increase the velocity of the stream has been to increase the size of the orifice, but this causes the concentration of solids to increase, which cools the surface more. Also, practicality has set a limit on the maximum size the orifice diameter can be made. As discussed in item c above, the orifice diameter cannot be larger than the supply line diameter and the orifice diameter should not be made so large that the supply line cannot maintain the liquid behind the orifice. Also, the orifice diameter cannot be larger than the diameter of the nozzle exit port.

Several attempts at increasing the velocity of the solids have been patented. The first is to create the solids using the 850 psi available in the cylinder and then provide a separate propellant, such as dry nitrogen, at a much higher pressure to force the solids out of the nozzle. This type of system is very complex and difficult to implement on a large scale. The second attempt was to spin the surface beneath the spray stream to effectively increase the velocity of the solids approaching the surface. The idea of spinning the part lent itself to using a symmetrical part, or the spindle would not be balanced and fly apart at higher velocities.

There is a need in the prior art by which the velocity of the spray stream exiting the nozzle can be increased without the adverse effects discussed above. This need has been satisfied by the present invention which basically involves increasing the pressure of the liquid in the supply line above 850 psi. Prior to this invention, the carbon dioxide spray cleaning equipment, based upon the liquid conversion nozzling technique, has relied upon the pressure inside a cylinder of compressed carbon dioxide (typically 800–875 psi) to serve as the propellant for the spray stream. No prior known attempt has been made to increase the pressure of the liquid carbon dioxide in the supply line, probably because it could cause the carbon dioxide to move beyond the critical temperature and pressure, and the equipment was unable to operate at higher pressures without bursting.

The carbon dioxide spray cleaning equipment, made in accordance with the present invention, is currently capable of operating at a working pressure of about 5,000 psi, six (6) times the conventional 850 psi working pressure. Within this capability, the supply line pressure can be significantly increased with a substantial safety margin. This is basically accomplished by a high pressure pump in the supply line and a two orifice nozzle. Verification experiments, using a supply line pressure of 1,000–2,500 psi, have established that by increasing the supply line pressure contaminants were effectively removed without damage to the surface, which contaminants could not be removed using a supply line pressure in the typical 850 psi range with the same nozzle configuration. In addition, the conversion of liquid into solid particles is very low compared to the prior liquid conversion STET techniques.

SUMMARY OF THE INVENTION

It is an object of the present invention to provide an improved carbon dioxide spray cleaning system.

A further object of the invention is to provide a solid/gas spray using a supply line pressure greater than 850 psi, regardless of the temperature of the liquid carbon dioxide in the supply line.

Another object of the invention is to provide a carbon dioxide solid/gas spray arrangement having a high nozzle exit velocity with a low (under 40%) concentration of solids in the spray stream.

Another object of the invention is to provide an improved spray cleaning system using single or multiple spray nozzles.

Another object of the invention is to provide a method and apparatus for solid/gas carbon dioxide spray cleaning capable of removing contaminants from delicate surfaces without damage to the surface.

Another object of the invention is to provide a solid/gas carbon dioxide spray method and apparatus using a pump to increase the liquid supply pressure to greater than 875 psi and a two orifice nozzle arrangement whereby existing nozzle spray stream velocity is increased while maintaining a low conversion rate of liquid to solid carbon dioxide particles.

Another object of the invention is to provide a solid/gas carbon dioxide spray cleaning system capable of withstanding pressures of up to as high as 10,000 psi for increasing the velocity of the solid carbon dioxide particles, thus increasing the available kinetic energy in the spray stream to enable removal of strongly adhered contaminants by carbon dioxide spraying without damage to the surface being sprayed.

Other objects and advantages of the present invention will become apparent from the following description and accompanying drawings. Basically, the invention involves a solid/gas spray cleaning system wherein the liquid supply line pressure is increased above 875 psi, preferably greater than 1,000 psi. This is accomplished, for example, by a high pressure pump in the supply line from a pressurized container to a nozzle, wherein the pressurized liquid is boosted to significantly greater pressures (e.g. 1,000–10,000 psi), the maximum pressure being controlled by the pressure capacity of the equipment so as to maintain a sufficient safety margin. Also, an unpressurized liquid container can be pressurized by a pump to above 875 psi whereby the nozzle spray stream exit velocity is increased while maintaining a low (up to about 40%) conversion of liquid to solid particles in the nozzle. A proof-of-concept demonstration of the invention was carried out using a high pressure mechanical pump whereby the pressure of liquid carbon dioxide to be forced through the nozzle was increased above 850 psi (pressures of 1,000 psi, 1,500 psi, and 2,500 psi), which caused the solid/gas carbon dioxide spray to exit the nozzle at a higher velocity Thus, rather than operating within the typical pressure range of 800–875 psi, corresponding to a change in temperature from 65°–72° F. respectively, typically used to obtain velocity increase, the pressure was maintained at above 850 psi, and higher exit velocities were obtained. With the higher velocity spray stream, contaminants which are unremovable by carbon dioxide spray cleaning with a supply line pressure of 800–875 psi were removed due to the increase in kinetic energy available in the spray stream as a result of increasing the velocity of the solid carbon dioxide particles striking the surface. Tests demonstrated that the cleaned surfaces were not damaged by the solid/gas carbon dioxide spray.

While verification tests were conducted only using carbon dioxide, spray cleaning using other types of solid/gas spray streams using higher pressures to increase the velocity of the solid particles are anticipated, but not experimentally verified.

Various applications in addition to cleaning of electronic components, optical components, etc. may include cleaning of delicate surfaces such as camera and eyeglass lenses, ruled grating, and finger prints, etc. and remove road grime from traffic signs and painted graffiti from surfaces without damage.

BRIEF DESCRIPTION OF THE DRAWINGS

The accompanying drawings, which are incorporated into and form a part of the disclosure, illustrate an embodiment of the invention and, together with the description, serve to explain the principles of the invention.

DETAILED DESCRIPTION OF THE INVENTION

The present invention is directed to a method and apparatus for controlling the exit velocity of a solid/gas carbon dioxide spray cleaning system using the liquid conversion nozzling technique. The principle features of the invention are a high pressure pump to increase the supply line pressure of liquid carbon dioxide above the pressure at which adiabatic expansion occurs for a liquid at any temperature, and a nozzle arrangement wherein a low percentage (less than 50%) of the liquid carbon dioxide is converted to solid particles, and wherein the exit velocity from the nozzle is high (100–3,000 ft./sec. depending on the pressure), whereby previous unremovable contaminants can be removed by the solid/gas carbon dioxide spray. The experimental test apparatus was constructed to withstand pressures of up to 5,000 psi, but equipment is available to increase that pressure to 10,000 psi. Experimental verification of the system of this invention was carried out using liquid carbon dioxide supply line pressures of 850 psi, 1,000 psi, 1,500 psi, and 2,500 psi, with the temperature at approximately 70° F. These tests determined that using supply line pressures greater than 850 psi, the conventional pressure, higher velocity spray streams were produced, and contaminants unremovable by the 850 psi spray were removed by the higher pressure spray. This was due to the increase in kinetic energy available in the spray stream as a result of increasing the velocity of the carbon dioxide particles that were striking the surface. These tests also established that the conversion of liquid carbon dioxide to solid carbon dioxide particles (snow) was substantially lower than that of prior known liquid conversion techniques, the prior conversion rate being about 40% compared to a 5–10% conversion using the high pressure pump and nozzle arrangement of the present invention. The experimental tests also established that the high velocity spray stream did not damage the surfaces being cleaned.

While experimental tests thus far conducted have been limited for safety considerations to a pumping pressure of 2,500 psi with equipment capable of withstanding 5,000 psi, equipment is available to withstand pressures of 10,000 psi and greater. Thus, liquid supply line pressures of 5,000–10,000 psi and greater can be safely utilized, with the maximum effective pressure still undetermined by experimental testing. The supply line pressure and the nozzle exit velocity are factors which should be considered in determining optimum cleaning without surface damage. Different surfaces will require different solid particle velocities and thus different liquid supply line pumping pressures.

Figure 1:
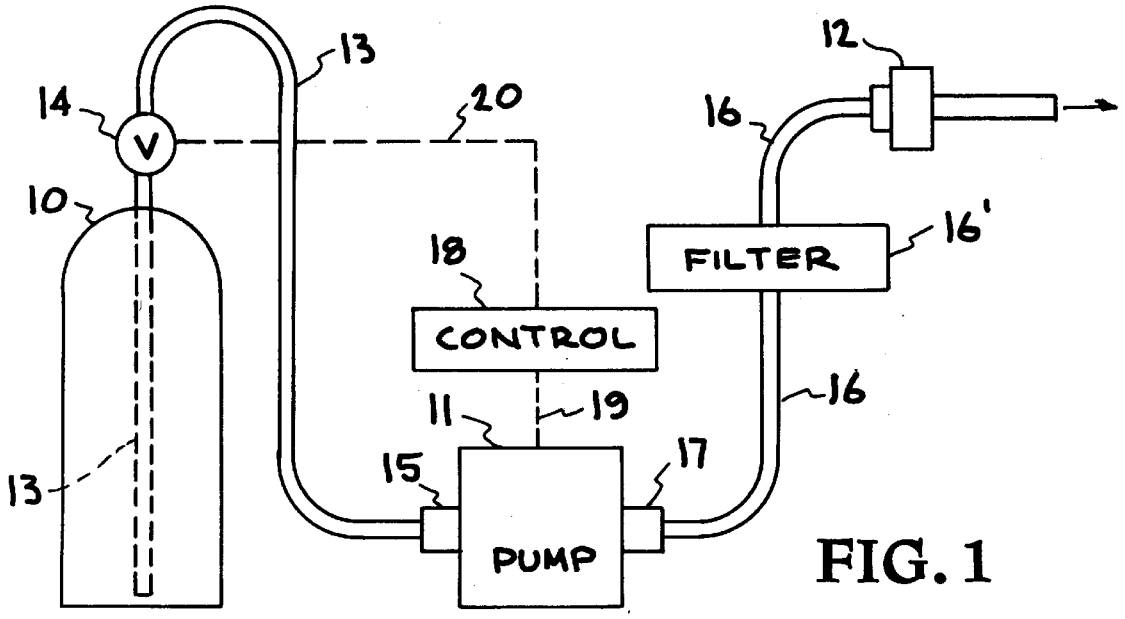
FIG. 1 illustrates schematically an embodiment of a solid/gas spray cleaning system made in accordance with the present invention.
Figure 2:
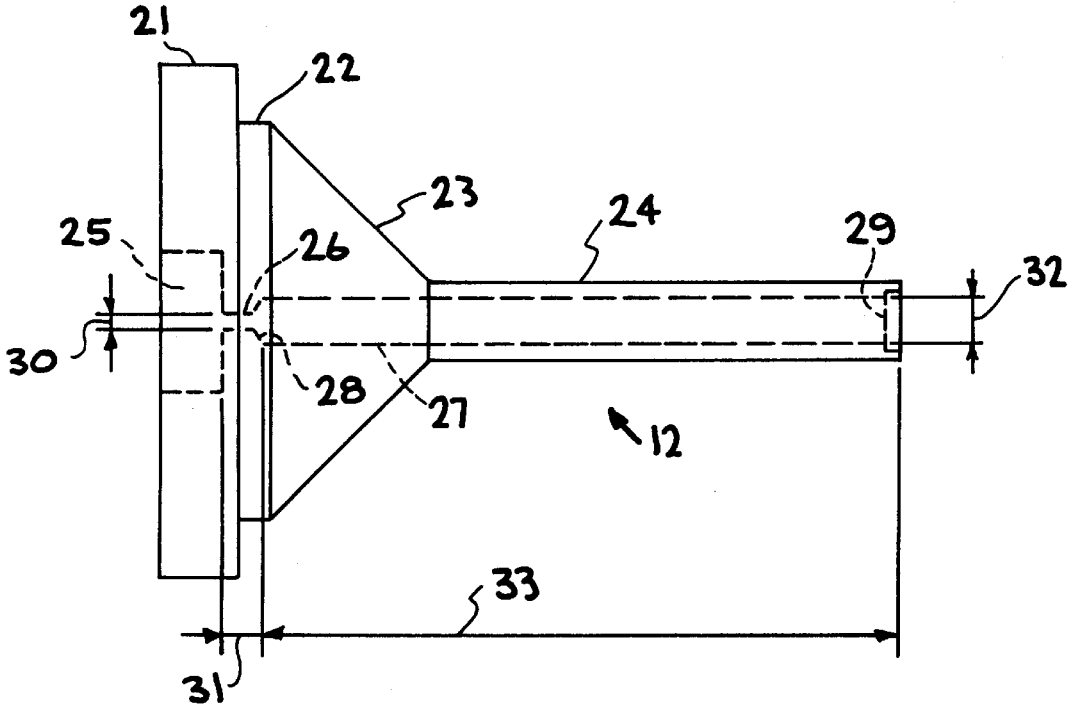
FIG. 2 schematically illustrates an embodiment of a liquid conversion nozzle in accordance with the invention.

Referring now to the drawings, FIG. 1 schematically illustrates an embodiment of a solid/gas carbon dioxide spray cleaning system, with FIG. 2 schematically illustrating an embodiment of a nozzle assembly for the FIG. 1 system. The FIG. 1 system basically comprises a liquid carbon dioxide supply tank 10, a variable speed/variable pressure pump 11, and a nozzle assembly 12. A supply line 13 extends from a lower section of tank 10 via a valve assembly 14 to an inlet or intake 15 of pump 11, and a supply line 16 extends from an output or exhaust 17 of pump 11 to nozzle assembly 12, in which is located a filter 16'. A control assembly 18 is connected to pump 11 and valve assembly 14 as indicated by dash lines 19 and 20. The liquid tank 10 may be a typical liquid carbon dioxide cylinder, typically containing a pressure of about 850 psi, or it may be a larger tank with liquid carbon dioxide under pressures from 0–875 psi. The supply lines 13 and 16, as well as valve assembly 14, are constructed to safely retain liquid supply pressures of up to at least 10,000 psi. The valve assembly 14 may be manually controlled, or be automatically controlled by control assembly 18 as indicated by dash line 20. The pump 11 is controlled by control assembly 18 as indicated by cash line 19 to control the pump speed and/or pressure output of liquid carbon dioxide flowing through line 16 to nozzle assembly 11. Various types of pumps are commercially available to provide a continuing supply of liquid carbon dioxide at pressures greater than 850 psi, up to 5,000–10,000 psi.

There are six (6) significant parameters of a nozzle design, these being: 1) orifice diameter, 2) orifice length, 3) exit diameter, 4) exit length, 5) reservoir diameter, and 6) reservoir length. There should be a transition between the diameter of the inlet section and outlet section of the nozzle orifice to provide smooth fluid flow, and is shown in FIG. 2 as a tapered section. For any particular nozzle design, each of the above-identified six significant parameters is set to develop certain characteristics of the spray exiting the nozzle. The spray characteristics include size of the solid particles, quantity of solid particles, ratio of solid particles to gas in the spray, velocity of the exiting spray, and the pattern created by the spray. The pattern created by the spray can be changed by the outlet configuration of the orifice exit. For example, a circular exit may include an enlargement adjacent the end of the orifice which can be circular or of another configuration, as illustrated in FIG. 2.

Referring now to the embodiment of the nozzle assembly as illustrated in FIG. 2, the nozzle assembly 11 comprises a housing or body having four different diameter sections 21, 22, 23 and 24. Housing section 21 includes a liquid carbon dioxide reservoir 25 which is adapted to be connected to supply line 16 by conventional adapters or connectors not shown, and may have a diameter or cross-section equal to the internal diameter or cross-section of line 16. Housing sections 22 and 23 may be integral or separate sections and function to connect larger diameter housing section 21 to section 24 having a smaller diameter. The housing sections 21 and 22 are provided with an inlet passageway or orifice 26 connected to reservoir 25, while housing sections 22, 23 and 24 are provided with an exit passageway or orifice 27 larger in diameter than orifice 26 and connected to orifice 26 by a tapered section 28. Exit orifice 27 may include an enlarged section at the outer end, indicated at 29. As known in the art, and as described above, the orifices 26 and 27 are different in diameter or cross-section and designed to convert a portion of the carbon dioxide passing through reservoir 25 into carbon dioxide particles (commonly known as snow). Due to the liquid carbon dioxide rapidly expanding as it passes through the smaller inlet orifice 26 into larger exit orifice 27 forming carbon dioxide gas which serves as the propellant for the carbon dioxide particles. As the liquid droplets give up their heat, the liquid on the outside of the droplets expand to become carbon dioxide gas, the temperature of the central core drops to approximately −110° F. and the droplets freeze to form the solids in the spray stream. As pointed out above, this process, commonly referred to as adiabatic expansion, causes solids to form when a liquid under pressure is allowed to expand rapidly. The pressure of the liquid must be sufficient to cause the rapid expansion or the solids will not form and only liquid or gas will exit the nozzle.

By way of example, the embodiment of the nozzle assembly illustrated in FIG. 2 may have a reservoir 25 with a diameter of ¼ to ½ inch and depth of ¼ to ½ inch, with inlet orifice 26 having a diameter as indicated by arrows 30 of 0.001 to 0.010 inch, and length indicated by arrow 31 of 0.020 to 0.100 inch, with exit orifice 27 having a diameter as indicated by arrow 32 of 0.050 to 0.250 inch, and a length as indicated by arrow 33 of ¼ to 2.5 inch, with the tapered section 28 tapering at a 15 to 60 degree angle, for example, but may be greater or less. The nozzle assembly utilized in the experimental verification tests using supply line pressures from 850–2,500 psi used an inlet orifice 26 having a diameter of 0.008 inch and length of 0.050 inch, and exit orifice 27 having a diameter of 0.050 inch and length of 2.5 inch, with the tapered section 28 being at a 30 degree angle. The orifices 26 and/or 27 may be of a cross-section or configuration other than annular. The solid particle size may, for example, be 0.1 microns to 100 microns, with a percentage ratio of solid particles to gas of 30:70 to 50:50; and it is estimated that the velocity of the solid particles exiting the orifice is in the range of 100–3,000 ft./sec.

Figure 4:
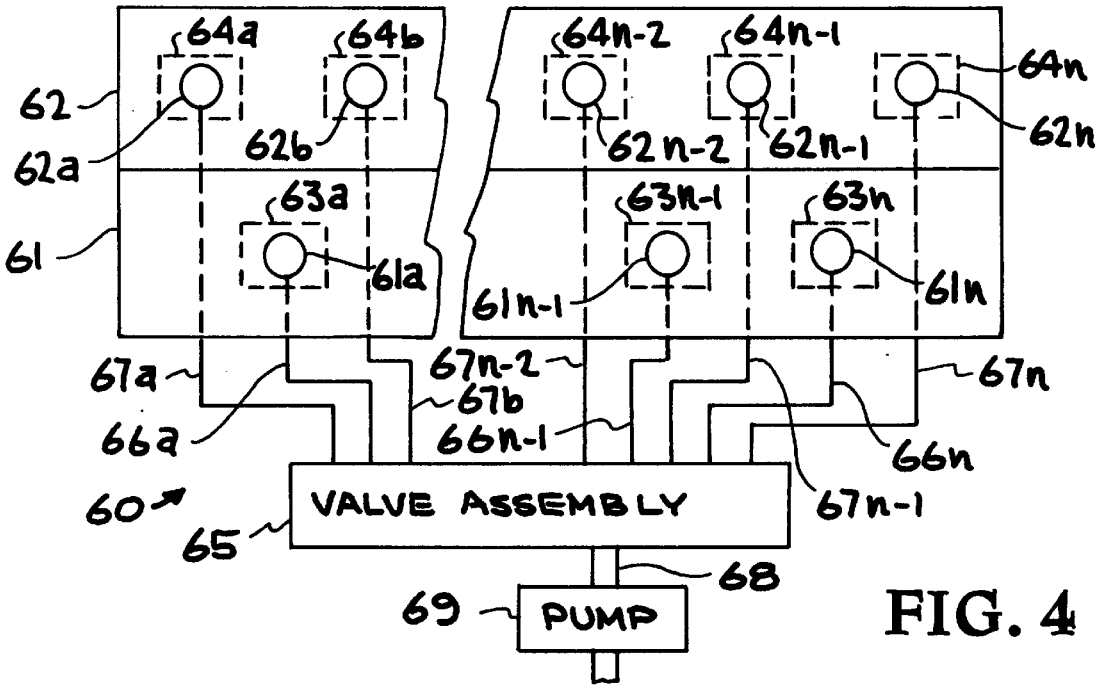
FIG. 4 schematically illustrates a multi-orifice arrangement with each orifice having a reservoir similar to the FIG. 2 embodiment.

The nozzle design illustrated in FIG. 2 only contains the essential elements for converting an incoming liquid to an exiting solid gas spray stream by passing the liquid through an orifice allowing it to expand rapidly. Such an in-line nozzle design, however, is very limited in capability and application. The reason is the shape of the exit orifice is small and round. Many applications for this cleaning technique are large flat surfaces such as the components used in flat panel displays that can be as large as 14×14 inches and eventually 1×1 meters. Using a small round exit orifice (the maximum diameter of a single exit orifice nozzle is about ¼ inch diameter) several passes must be executed in order to clean the entire surface. Before the last pass can be completed, the area where the cleaning began will likely become contaminated from dirt removed earlier by the cleaning process. In order to clean a wider swath, a linear array of orifices is used which produces a knife-edge spray pattern so the cleaning can take place in a single pass. Several linear arrays can be combined to form rectangular arrays capable of cleaning an entire surface in a single pass. Usually, the linear or rectangular orifice arrays must be supplied by more than one incoming supply line because 850 psi is insufficient to supply several consuming orifices. FIG. 4 illustrates a rectangular orifice array composed of two linear orifice arrays, each orifice having an individual reservoir which is fed by a pump and valve arrangement.

Figure 5:
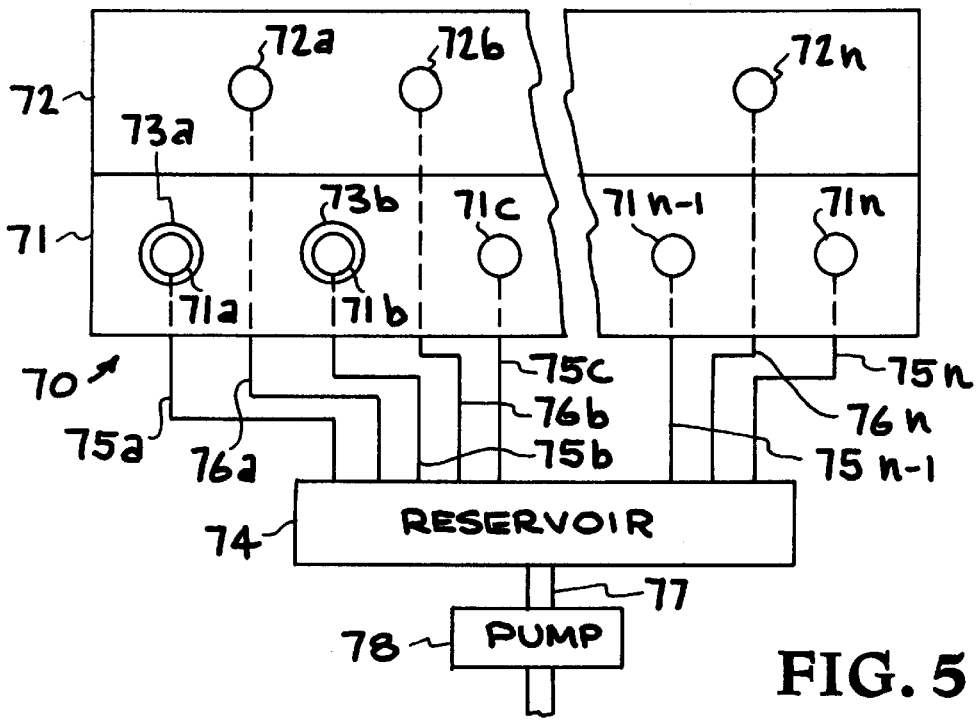
FIG. 5 schematically illustrates a multi-orifice arrangement using a common reservoir.

Another unique feature of the high pressure spray system of the present invention is that several orifices arranged in a linear array, or even a rectangular array, can be supplied by a single inlet supply line because the pressure in the supply line will be capable of keeping the reservoir(s) full. This makes possible rectangular arrays that can clean an entire 1×1 meter surface in a single 1/20 second pulse instead of a single nozzle/multiple pass process. The entire array can be supplied by a single inlet supply line from the pump via a single reservoir at sufficient pressure to support adiabatic expansion at every orifice. With a reservoir of sufficient volume behind the orifices it ensures that no spitting or sputtering would occur in the spray stream. FIG. 5 illustrates an embodiment of a rectangular orifice array, similar to that of FIG. 4 except a common reservoir for all orifices is utilized.

Therefore, the nozzle arrangement of the present invention may contain one or multiple orifice configurations containing a limiting or inlet orifice in-line with an exiting orifice, each of particular diameter and length. Each limiting or inlet orifice is connected to a reservoir, either individual or common, of sufficient volume to prevent spitting and sputtering. With the linear and/or rectangular orifice array arrangement a single nozzle design may contain several, even hundreds, of exiting orifices depending upon the requirements of the application.

For each nozzle design, there are six (6) significant parameters, as set forth above. Also, the transition section between the inlet and exit orifices, shown as a taper in FIG. 2, should be designed to provide proper expansion from the inlet to the larger exit orifice. In addition, the outer end of the exit orifice may be enlarged and configured to provide a desired spray pattern. FIG. 2 illustrates an enlarged annular exit area, but such could be square, rectangular, triangular, etc.

For any particular nozzle design, each of the above-listed six parameters is set to develop certain characteristics of the spray exiting the nozzle, be there one or multiple exit orifices in the nozzle design. The spray characteristics include size of the solid particles, quality of the solid particles, ratio of solid particles to gas in the spray, velocity of the exiting spray, and the pattern created by the spray. Thus, any or all of the parameters of the reservoir, inlet and exit orifice diameters, and length of the orifices, as well as the configuration of the exit orifice, may change for each nozzle design. Thus, the above-listed parameters of the FIG. 2 nozzle are exemplary only.

Figure 3:
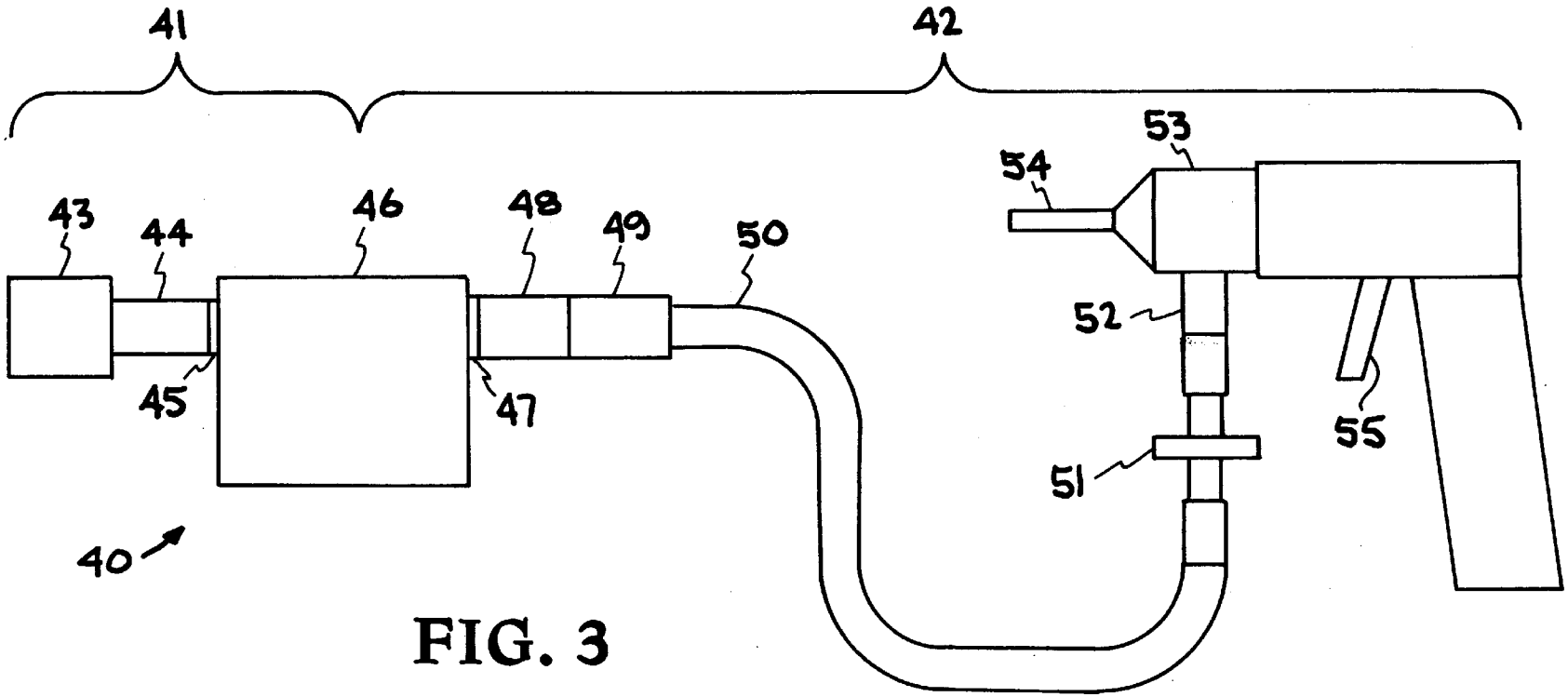
FIG. 3 illustrates an embodiment of the invention for connection to a supply tank.

FIG. 3 illustrates an embodiment of the high pressure spray system of the invention for connection to a supply tank or cylinder. The nozzle of the valve/spray gun may include one or more orifices, as discussed above and described hereinafter with respect to FIGS. 4 and 5. The FIG. 3 embodiment, generally indicated at 40, comprises a low pressure section indicated by arrow 41 and a high pressure section 42. Low pressure section 41 includes a tank or cylinder, not shown, such as tank 10 of FIG. 1, to which is connected via a nut 43, nipple 44 and an inlet or intake 45 to a high pressure pump 46. The high pressure section 42 includes pump 46, a pump outlet or exhaust 47, check valve 48, valve 49, high pressure hose or line 50, filter 51, a fitting 52 connecting filter 51 to a valve/spray gun, generally indicated at 53, having a nozzle assembly 54 and a trigger 55. As pointed out above, the nozzle assembly 54 may be of a single orifice/reservoir arrangement, as illustrated in FIG. 2 or a multiple linear/rectangular orifice/reservoir arrangement as illustrated in FIGS. 4 and 5. With the high pressure pump 46 in operation, movement of the trigger 55 of the valve/spray gun 53 causes solid particle/gaseous carbon dioxide to be discharged from nozzle assembly 54 onto a point of use.

FIG. 4 illustrates a nozzle arrangement composed of two linear orifice arrays to form a rectangular orifice array. While two linear orifice arrays are illustrated, any number may be utilized. Also, the number of orifices in each linear array will depend on the application for the nozzle assembly. As illustrated in FIG. 4, a nozzle assembly 60 consists of two linear orifice arrays 61 and 62, each array 61 and 62 consisting of a number of orifices indicated at 61*a,* 61*n*-1 and 61*n;* and 62*a,* 62*b*, 62*n*-2, 62*n*-1 and 62*n,* respectively. Each orifice in each array 61 and 62 is provided with a reservoir indicated at 63*a,* 63*n*-1 and 63*n*; and 64*a,* 64*b*, 64*n*-2, 64*n*-1 and 64*n* respectively, with each reservoir being connected to a valve assembly 65 by high pressure supply lines 66*a,* 66*n*-1, 66*n;* and 67*a*, 67*b*, 67*n*-2, 67*n*-1 and 67*n* respectively. Valve assembly 65 is connected by a high pressure hose or line 68 to a high pressure pump 69 connected to a supply tank, and hose or line 68 may include a filter as illustrated in the FIG. 3 embodiment.

FIG. 5 illustrates a nozzle arrangement similar to the FIG. 4 embodiment except that the individual orifices are connected to a common reservoir. The FIG. 5 embodiment generally indicated at 70 utilizes two linear orifice arrays 71 and 72, each array consisting of a number of orifices as indicated at 71*a,* 71*b*, 71*c,* 71*n*-1 and 71*n;* and 72*a*, 72*b* and 72*n* respectively. The orifices may include an enlarged end section as illustrated in FIG. 2 with only two orifices enlarged for simplicity as shown at 73*a* and 73*b*. These enlarged orifice ends, if used, may be annular or of another desired configuration, as described above. Each of the orifices are connected to a common reservoir 74 via high pressure lines 75*a*, 75*b*, 75*c,* 75*n*-1 and 75*n;* and 76*a,* 76*b*, and 76*n* respectively. Reservoir 74 is connected by a high pressure hose or line 77 to a high pressure pump 78, the inlet of pump 78 being connected to a supply tank, such as tank 10 in FIG. 1. Also, while not shown, a filter may be utilized in hose or line 77, as in FIG. 1.

Figure 6:
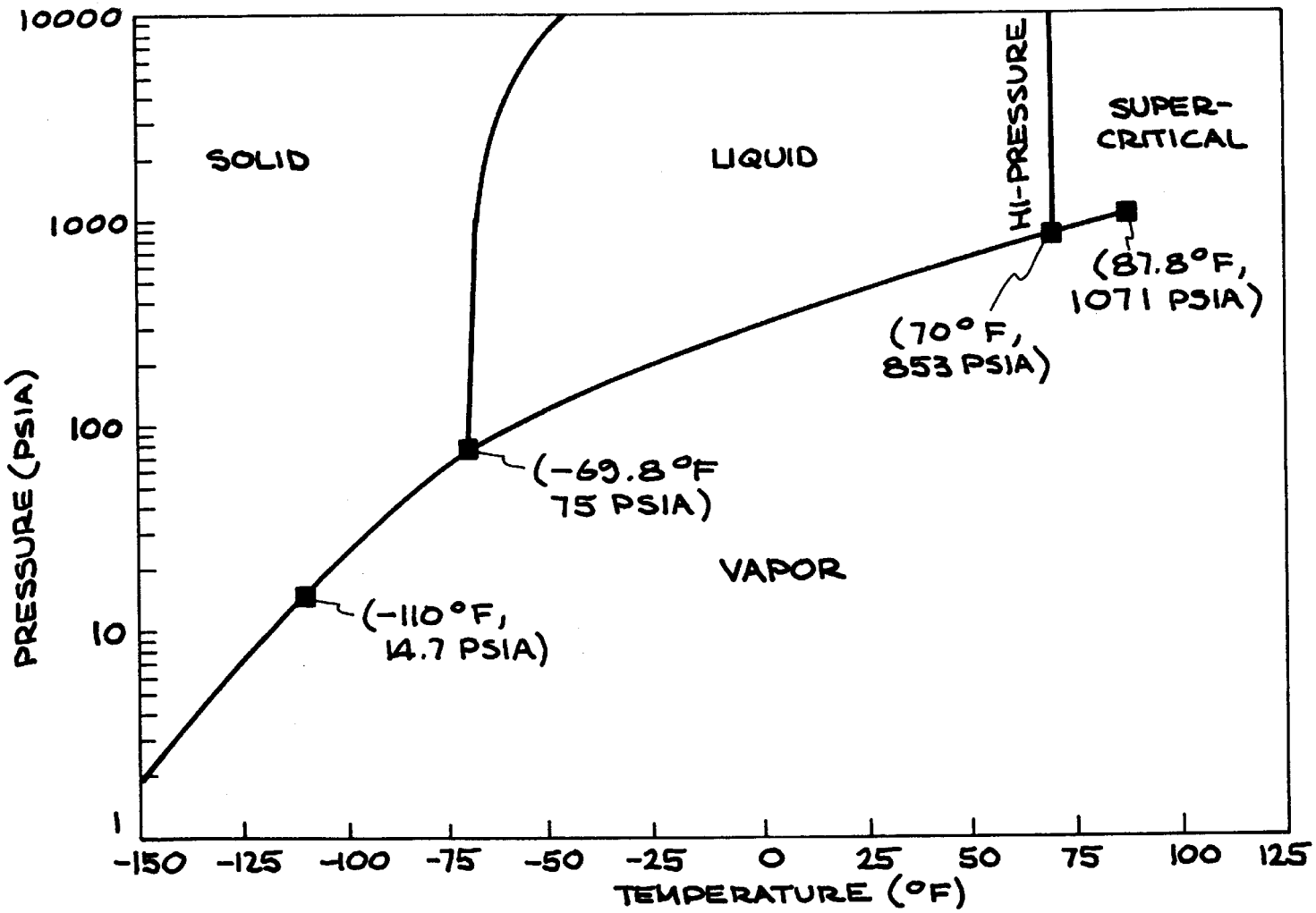
FIG. 6 is a phase diagram for carbon dioxide showing the high pressure range.

As shown in FIG. 6, the liquid phase of carbon dioxide exists to the right of the solid/liquid line and above the vapor phase line indicated on the chart by the line connecting the points (−69.8° F., 75 psi) and (70° F., 853 psi), and at a temperature higher than the freezing temperature ranging from −70° F. to −45° F. between 75 psi and 10,000 psi respectively, and 87.8° F., the temperature when carbon dioxide enters the supercritical phase. Changing the pressure of the liquid carbon dioxide by an external pump apparently did not cause a change in phase. However, if the phase did change to supercritical, it did not prevent the generation of solid particles in the spray stream. This means that the pressure can be increased to the limits of the equipment and within the realm of safety when attempting to increase the velocity of the solids to remove more stubborn contaminants. Thus, by this invention the pump can force the pressure of the liquid carbon dioxide, at any temperature, greater than the solid/liquid boundary line illustrated in FIG. 6, high enough to support adiabatic expansion, thus causing a solid/gas spray to exit the nozzle. The entire region of FIG. 6 above the vapor phase line and to the right of the solid/liquid line can be utilized to produce a solid/gas spray by increasing the supply line pressure. This expanded region greatly broadens the capability of the spray cleaning apparatus rather than being able to operate at only a single temperature or in the temperature range above 65° F. which corresponds to a minimum pressure of approximately 800 psi.

By increasing the pressure of the supply line, all of the aforementioned limitations have been removed from the process, namely:

a) nozzle type—liquid conversion nozzles can be made to have small concentrations of solids in the spray stream with extremely high velocities.

b) surface cooling—a lower concentration of solids will minimize the temperature drop of the surface being cleaned.

c) consumption rate—any previous maximum limit of the ratio of orifice to supply line diameters no longer exists.

d) temperature vs. pressure—the pressure of any liquid carbon dioxide at a temperature above the freezing temperature can be increased such that adiabatic expansion will occur and generate solid carbon dioxide particles in a spray stream.

e) velocity of solids—the velocity of the solids can be increased limited only by the design of the equipment.

Evaluation of the invention was carried out for the purpose of verifying that by increasing the pressure of liquid carbon dioxide, such enhanced the performance of the solid/gas carbon dioxide spray cleaning system. This evaluation was carried out as follows:

A standard item of solid/gas carbon dioxide spray cleaning equipment was modified by introducing a high-pressure pump into the liquid carbon dioxide supply line. With the pump at idle, the pressure of the liquid carbon dioxide in the supply line remained at approximately 850 psi at a temperature of 70° F. With the pump operating, the pressure of the liquid carbon dioxide in the supply line was increased from 850 psi up to 2,500 psi, while the temperature remained at 70° F.

During this preliminary evaluation, increasing the pressure had the following effects on the performance of the spray cleaning equipment:

1. The spray exiting the nozzle continued to deliver a combination of microscopic carbon dioxide solids mixed with a stream of gaseous carbon dioxide.

2. The exit pressure of the spray increased significantly.

3. The cleaning efficiency of the spray stream increased dramatically. This was demonstrated by removing fingerprints in a single pass of the spray stream, as well as dried polishing compound, deposition of facial oil, and brake dust from the inside of an automobile hub cap.

4. There does not appear to be a limit as to how high the pressure of the carbon dioxide can be before the equipment ceases to produce solids in the spray stream.

The demonstration proved that by significantly increasing the pressure of the carbon dioxide in the supply line of the cleaning equipment that the equipment continued to operate successfully, more efficiently, and more effectively than before.

It has thus been shown that the present invention provides a method and apparatus, using single and multiple spray orifices, for controlling the exit velocity of a solid/gas carbon dioxide spray cleaning system. This liquid conversion technique draws the liquid carbon dioxide from the bottom of a tank or cylinder through a supply line wherein the pressure is increased to above 850 psi, preferably above 1,000 psi (up to 5,000–10,000 psi), and presents the high pressure liquid carbon dioxide at an orifice in a nozzle assembly, wherein up to about 40% is converted to carbon dioxide particles (solids), with the remaining converted to carbon dioxide gas which serves as a propellant for the carbon dioxide particles which are discharged from the nozzle at a high velocity. Based on testing carried out thus far, the velocity of the solids can be increased to the limitation of the equipment being used by merely increasing the liquid supply pressure above the typical 800–875 psi range. The maximum pressure and the maximum velocity of the solids in the spray stream are limited by the design of the equipment so as to provide an adequate safety margin.

While the invention as illustrated and described has been directed to carbon dioxide spray cleaning systems, other materials, though not tested, which can produce the desired low liquid to solid conversion rates and the high solid velocity rates can be used. For example, liquid nitrogen or nitrogen gas and water may produce the desired solid/gas flow stream through a nozzle arrangement designed to freeze a portion of the liquid nitrogen or freeze water droplets which are propelled by nitrogen gas.

While particular embodiments of the invention have been described and/or illustrated, and particular materials, parameters, etc. have been set forth, such are not intended to be limiting. Modifications and changes may become apparent to those skilled in the art, and it is intended that the invention be limited only by the scope of the appended claims.

What is claimed:

1. In a liquid conversion solid/gas spray cleaning system including a pressurized supply of liquid carbon dioxide, a supply line and a nozzle assembly, the improvement comprising:

means located intermediate said pressurized liquid carbon dioxide and said nozzle assembly for increasing supply line pressure to said nozzle assembly to above 875 psi while maintaining the liquid carbon dioxide in the supply line at a constant temperature;

said nozzle assembly being constructed to convert a portion of the liquid supply to solid particles.

2. The improvement of claim 1, wherein said nozzle assembly is selected from the group consisting of single and multiple orifice nozzles.

3. The improvement of claim 1, wherein at least a greater portion of the liquid carbon dioxide is converted by said nozzle assembly to gas which functions as a propellant for said solid particles.

4. The improvement of claim 3, wherein said nozzle assembly is constructed to enable orifice exit velocity of said solid particles in a range of about 100 to 3,000 ft./sec.

5. The improvement of claim 1, wherein said means is constructed to produce a liquid supply pressure of above 875 psi to about 10,000 psi.

6. The improvement of claim 1, wherein said liquid carbon dioxide is at an initial pressure in the range of about 75–875 psi.

7. The improvement of claim 6, wherein said means is located in said supply line and increases the pressure of said liquid carbon dioxide to above 1,000 psi.

8. The improvement of claim 1, wherein said nozzle assembly includes at least one orifice construction composed of an inlet orifice connected to an exit orifice, said inlet orifice being smaller in cross-section than said exit orifice.

9. The improvement of claim 8, wherein said inlet orifice has a length of about 0.020 to 0.100 inch , and a diameter of about 0.001 to 0.010 inch, and wherein said exit orifice has a length of about ¼ to 2.5 inch, and a diameter of about 0.050 to 0.250 inch.

10. The improvement of claim 9, wherein said inlet and exit orifices are interconnected by a tapered surface.

11. An apparatus for solid/gas carbon dioxide spray cleaning, comprising:

a container containing liquid carbon dioxide, a pump operatively connected to said container, and a nozzle assembly having one or multiple orifices operatively connected to said pump, said pump being constructed to draw liquid carbon dioxide from said container and deliver the liquid carbon dioxide to said nozzle assembly at a pressure sufficient to cause adiabatic expansion thus forming solids in a gaseous spray stream.

12. The apparatus of claim 11, additionally including a supply line intermediate said container and said pump, and intermediate said pump and said nozzle assembly.

13. The apparatus of claim 12, wherein said supply line is constructed to withstand pressures of up to 10,000 psi.

14. The apparatus of claim 11, additionally including a valve assembly located intermediate said container and said pump assembly.

15. The apparatus of claim 14, additionally including a control assembly for said valve assembly.

16. The apparatus of claim 11, additionally including a control assembly for said pump.

17. The apparatus of claim 11, wherein said nozzle assembly includes at least one inlet orifice and exit orifice constructed to cause a portion of said carbon dioxide delivered by said pump to be converted to carbon dioxide particles, and another portion of said carbon dioxide to be converted to carbon dioxide gas.

18. The apparatus of claim 17, wherein said carbon dioxide particles exiting from said exit orifice have a velocity in the range of about 100 to 3,000 ft./sec.

19. The apparatus of claim 11, additionally including a filter intermediate said pump and said nozzle assembly.

20. The apparatus of claim 11, wherein said nozzle assembly includes multiple orifices, and additionally including at least one reservoir between said pump and said orifices.

21. The apparatus of claim 20, wherein each of said multiple orifices includes a reservoir connected to said pump.

* * * * *